United States Patent [19]

Riboli

[11] Patent Number: 4,633,917

[45] Date of Patent: Jan. 6, 1987

[54] WEFT THREAD STORAGE DEVICE FOR A WEAVING MACHINE

[75] Inventor: Gianni Riboli, Laupen, Switzerland

[73] Assignee: Maschinenfabrik Sulzer-Rüti AG, Rüti, Switzerland

[21] Appl. No.: 672,142

[22] Filed: Nov. 16, 1984

[30] Foreign Application Priority Data

Nov. 22, 1983 [EP] European Pat. Off. ..... 83810545.0

[51] Int. Cl.[4] ..... D03D 47/36; B65H 51/20

[52] U.S. Cl. ..... 139/452; 242/47.01; 242/47.12

[58] Field of Search ..... 139/452; 242/47.01, 242/47.12, 47.13

[56] References Cited

U.S. PATENT DOCUMENTS

| | | | |
|---|---|---|---|
| 3,761,031 | 9/1973 | Pfarrwaller | 242/47.01 |
| 4,180,215 | 12/1979 | Nurk | 139/452 |
| 4,235,388 | 11/1980 | Jacobsson | 242/47.01 |
| 4,498,639 | 2/1985 | Deborde | 242/47.01 |

FOREIGN PATENT DOCUMENTS

| | | | |
|---|---|---|---|
| 2028543 | 11/1971 | Fed. Rep. of Germany | 242/47.12 |
| 2920629 | 1/1980 | Fed. Rep. of Germany | 242/47.12 |

*Primary Examiner*—Werner H. Schroeder
*Assistant Examiner*—Joseph S. Machuga
*Attorney, Agent, or Firm*—Werner W. Kleeman

[57] ABSTRACT

The weft thread storage device contains a winding drum arranged eccentrically to a stationary axis. The winding drum is provided with a plurality of thread support rods on the side thereof which is opposite to the eccentric portion thereof. The thread support rods rotate conjointly with the winding drum. The winding reel composed of the winding drum and thread support rods carries the weft thread coils or wrappings. An end face of this winding reel supports a thread guide disk mounted on an intermediate support disk. The thread guide disk is constructed such that the outer circumference thereof everywhere exhibits the same distance from a balloon-breaker housing. In one upper portion of the thread storage device this distance is defined by the upper portion of the winding drum. In this manner it can be achieved that approximately the same centrifugal force arises in the balloon of the withdrawn weft thread at all times, so that the balloon can not be thrown at any location thereof against the inner circumference of the balloon-breaker housing with strongly varying blows. Thus, high loading of the weft thread is avoided so that, in particular, breakage of fibrils of glass fiber weft material is prevented. Hence even delicate weft threads, e.g. glass fiber materials, can be processed. The fabric remains free of fibril fractures such as can arise in withdrawing weft thread under strongly varying centrifugal force and under blows of the thread balloon against the balloon-breaker housing.

7 Claims, 3 Drawing Figures

A
D
D

WEFT THREAD STORAGE DEVICE FOR A WEAVING MACHINE

BACKGROUND OF THE INVENTION

The present invention broadly relates to weaving machines and, more specifically, pertains to a new and improved construction of a weft thread storage device for a weaving machine.

Generally speaking, the weft thread storage device of the present invention comprises a winding reel having a weft thread withdrawal face, radially adjustable peripheral thread support rods provided on the winding reel, and a balloon-breaker housing for checking ballooning of the weft thread to be withdrawn from the winding reel and inserted into a weaving shed of the weaving machine.

In a hitherto known weft thread storage device of this type, known for instance from the German Patent Publication No. 2,920,629, published Mar. 1, 1980 and the cognate U.S. Pat. No. 4,238,080, granted Dec. 9, 1980, a winding reel during operation is stationarily arranged, and more or less eccentrically adjustable in relation to a stationary weft thread storage device axis according to the particular radial position which the adjustable circumferential elements assume. If the weft thread storage device is employed in association with a balloon-breaker housing on the weft thread withdrawal side, as is disclosed in the German Pat. No. 2,028,543, published Nov. 25, 1971 and the cognate U.S. Pat. No. 3,761,031, granted Sept. 25, 1973 (cf. reference numeral 101), and as is usually the case, unequally great centrifugal forces can arise in the thread balloon of the withdrawn weft thread, since the balloon-breaker is arranged concentric to the axis of the weft thread storage device. The weft thread is then constantly beaten or whipped against the balloon-breaker housing with varying intensity. According to the type of weft thread, these non-uniform centrifugal forces can have a detrimental effect upon the thread. In particular, individual fibrils, for instance, of a glass fiber weft thread can fracture, which can lead to weaving flaws.

SUMMARY OF THE INVENTION

Therefore, with the foregoing in mind, it is a primary object of the present invention to provide a new and improved construction of a weft thread storage device which does not exhibit the aforementioned drawbacks and shortcomings of the prior art constructions.

Another and more specific object of the present invention aims at providing a new and improved construction of a weft thread storage device of the previously mentioned type which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the weft thread storage device of the present invention is manifested by the features that it comprises a thread guide member or disk arranged concentrically upon the weft thread withdrawal face or end of the winding reel in relation to the balloon-breaker housing for producing a substantially constant peripheral or radial distance between the winding reel and the balloon-breaker housing.

In this manner the centrifugal force arising in the withdrawn weft thread being inserted into the weaving machine can be maintained substantially constant, as has been demonstrated by experiments. The weft thread then no longer beats or whips intermittently against the balloon-breaker housing, but runs tangentially along the inner circumference of the balloon-breaker housing with essentially constant centrifugal force. Even sensitive or delicate weft threads, such as for instance those containing glass fiber materials, can then be inserted into the weaving shed of the weaving machine without damage. The fabric being woven contains no weaving flaws, e.g. visible discontinuities, attributable to fibril fracture of the weft thread.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 3:
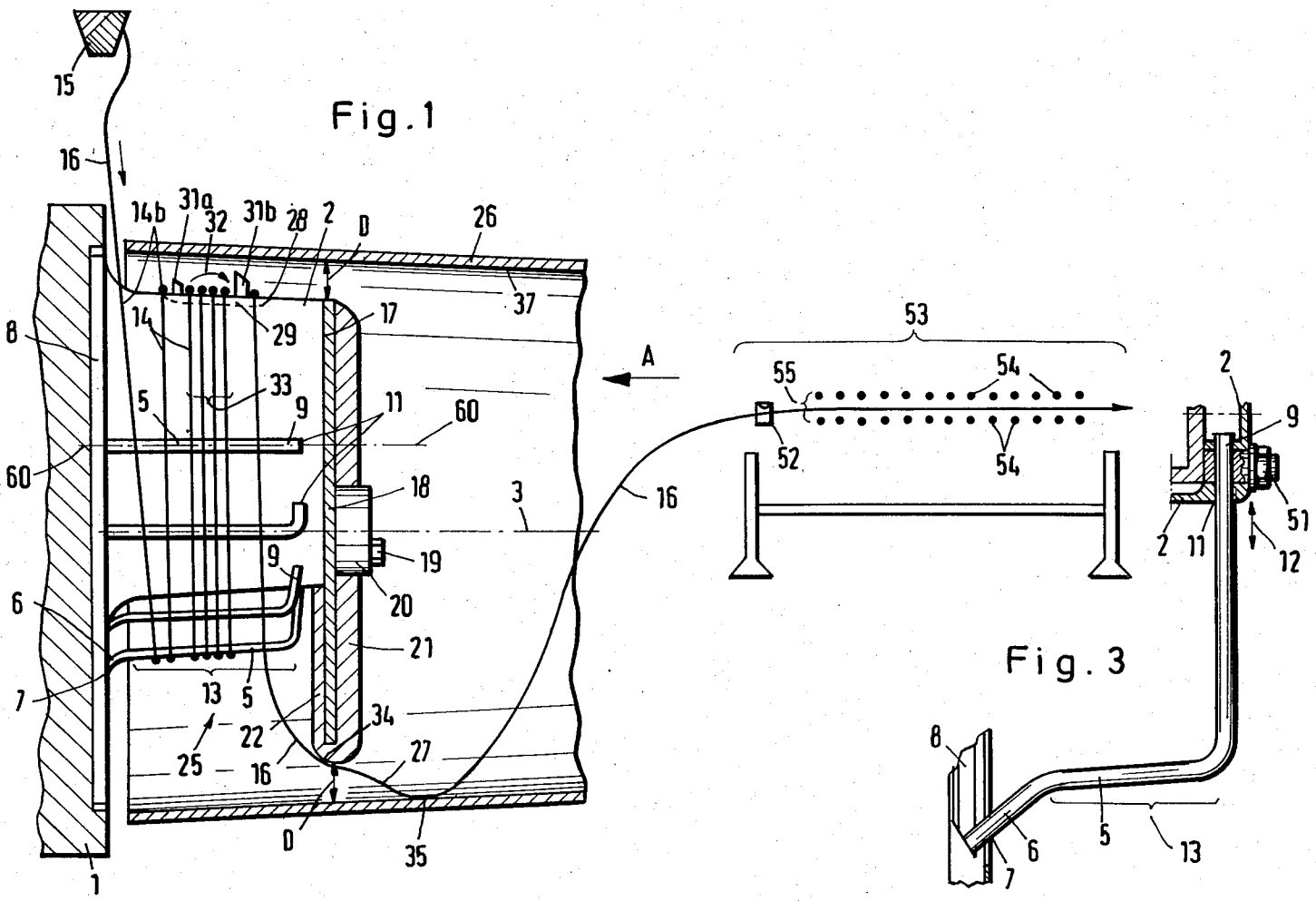
FIG. 1 schematically shows a side view of a weft thread storage device constructed according to the invention partially in section.
FIG. 3 schematically shows a detail from FIG. 1 on an enlarged scale.

Describing now the drawings, it is to be understood that to simplify the showing thereof only enough of the structure of the weft thread storage device has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a stationarily arranged frame 1. A winding drum 2 having an axis 60 is arranged to rotate about a stationary axis 3 (cf. arrow 4). A plurality of thread support rods or bars 5 are arranged on the side of the winding drum 2 which is lowermost in FIGS. 1 and 2. The thread support rods 5 rotate with the winding drum 2. A winding reel 25 is therefore formed and thus comprises the winding drum 2 and the thread support rods conjointly rotating about the stationary axis 3 which is eccentric with respect to the winding drum 2. Ends 6 of these thread support rods 5 protrude into slots 7 of a rotating circular base plate 8, while the other ends 9 of these thread support rods 5 engage bores 11 of the winding drum 2 and are radially adjustable therein according to the double-headed arrow 12 by means of clamp screws 51 or equivalent expedients. In this manner, supporting regions 13 of the thread support rods 15 which extend substantially parallel to the axis 3 can be radially adjusted so that the winding or coiling circumference of the winding reel 25 comprising the components 2 and 5 can be altered. In this manner, the length of a coil 14 of the weft thread 16 arriving from a package 15 can also be adjusted.

An intermediate support disk 18 is fastened to an end face 17 defining a weft thread withdrawal face of the winding drum 2. A thread guide disk 21 is shown partially broken away in the center in FIG. 2. This thread guide disk 21 is fastened upon the intermediate support disk 18 by means of a screw or threaded bolt 19 or the like arranged eccentrically to the axis 3 and a cover 20. A rear portion 22 of the thread guide disk 21 extends around the intermediate support disk 18.

The winding reel 25 is surrounded by a balloon-breaker or balloon-breaker housing 26 arranged concentrically to the axis 3. The balloon 27 of the withdrawn weft thread 16 is checked by the balloon-breaker or balloon-breaker housing 26. During weaving operation the weft thread 16 passes through an eyelet 52 of the schematically indicated weaving machine 53 into the weaving shed 55 formed by the warp threads 54. The weft thread 16 will typically be forcefully withdrawn from the winding reel 25 and inserted into the weaving shed 55 by any suitable means, such as for instance, mechanical gripper means or pneumatic nozzle transport means of the weaving machine.

A slot 29 extending essentially parallel to the axis 3 is provided in the circumference 28 of the winding drum 2. Pins 31 rotating conjointly with the winding drum 2 can extend through this slot 29. The pins 31, typically for instance four, may be caused to circulate within the winding reel 25 in synchronism with the rotation of the winding reel 25 by, for instance, a worm-driven disk or crank plate and planetary gearing. Although this mechanism is not particularly shown in the drawings, suitable details may be found in the aforementioned German Patent Publication No. 2,920,629, published Jan. 3, 1980, and the cognate U.S. Pat. No. 4,238,080, granted Dec. 9, 1980, the disclosure of which is incorporated herein by reference. As the pins 31 circulate and simultaneously rotate with the winding drum 2, the pins 31 move according to the arrow 32, so that they extend from the circumference of the winding drum 2 at position 31*a* and retract and therefore disappear from the circumference of the winding drum 2 at position 31*b*. In this manner the thread coil package 33 can be withdrawn overhead to the right as seen in FIG. 1 and inserted into the weaving shed 55. During weft thread withdrawal, new coils 14*b* are wound upon the winding reel 25 to the left of the position 31*a*.

Figure 2:
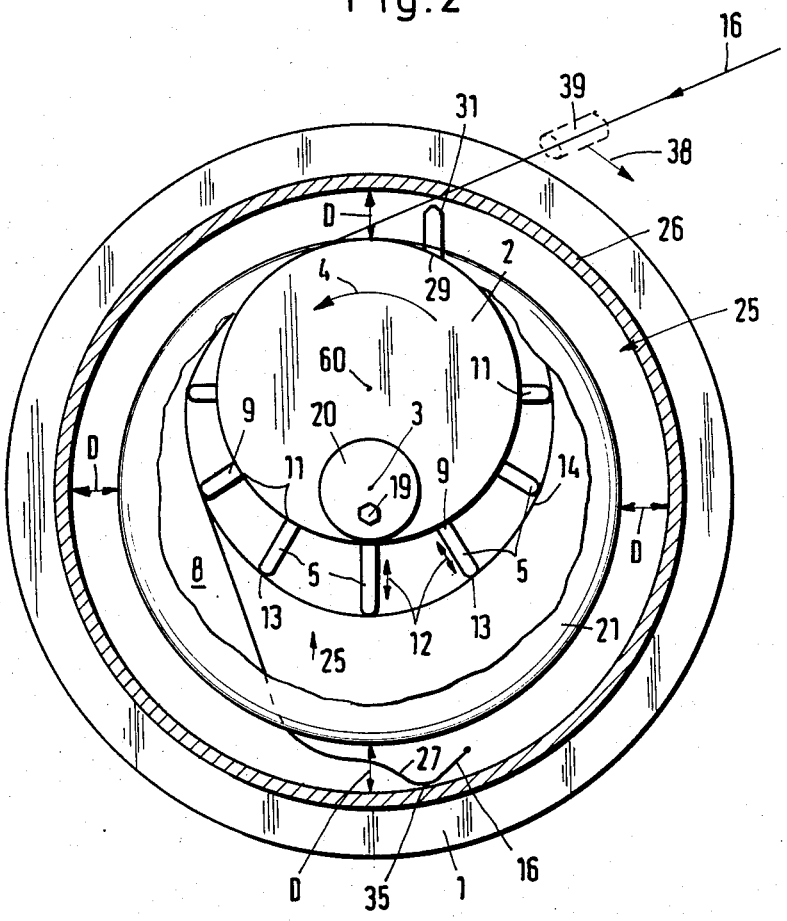
FIG. 2 schematically shows an associated end view taken in the direction of the arrow A in FIG. 1.

The thread guide disk 21 ensures that the distance D between the thread guide disk 21 and the balloon-breaker housing 26 remains essentially constant over the entire circumference, as can be particularly well seen in FIG. 2. The thread balloon 27 slides over the thread guide disk 21 at the position 34 and along the inner circumference 37 of the balloon-breaker housing 26 at the position 35. The centrifugal force which arises in the weft thread balloon 27 varies only slightly during weft thread withdrawal. In this manner, even sensitive threads can be processed, e.g. those containing glass fiber material. The constant or uniform centrifugal force in the weft thread balloon 27 prevents the withdrawn weft thread 16 from beating or whipping in the region of the balloon 27 with varying intensity against the inner circumference 37 of the balloon-breaker housing 26. In this manner fractures of the individual fibrils of the weft thread 16 and consequently weaving flaws or faults can be prevented.

In an alternate embodiment, the winding reel 25 composed of the components 2 and 5 can be stationary and the weft thread 16 can be supplied by a tubular flyer 39 rotating according to the arrow 38 and represented in FIG. 2 in dotted line. Instead of the continuous disk 21, a ring can also be employed as thread guiding member on the withdrawal side 17 of the winding reel 25. The shape of this ring would correspond approximately to the portion of the thread guide disk 21 shown in FIG. 2.

While there are shown and described present preferred embodiments of the invention, it is to be distinctly understood that the invention is not limited thereto, but may be otherwise variously embodied and practiced within the scope of the following claims.

Accordingly, what I claim is:

1. A weft thread storage device with a predetermined axis for a weaving machine, comprising:

means defining said predetermined axis at a stationary location laterally of a weaving shed of the weaving machine;

a winding reel having a weft thread withdrawal face and being arranged eccentrically with respect to said predetermined axis of the weft thread storage device;

said winding reel containing a plurality of radially adjustable peripheral thread support rods;

a balloon-breaker housing for substantially preventing excessive ballooning of weft thread to be withdrawn from said winding reel and which is to be inserted into a weaving shed of the weaving machine;

said balloon-breaker housing having an axis extending eccentrically with respect to said winding reel; and a thread guide disk arranged upon said weft thread withdrawal face of said winding reel substantially concentrically in relation to said balloon-breaker housing and having a circumference which extends at a substantially constant radial distance from said balloon-breaker housing such that said balloon-breaker housing and said circumference of said thread guide disk conjointly define a space devoid of further guide means for withdrawing weft thread.

2. The weft thread storage device as defined in claim 1, wherein:

said winding reel comprises a substantially drum-shaped component having an end face defining said weft thread withdrawal face; and said plurality of thread support rods being radially adjustable in relation to said drum-shaped component.

3. The weft thread storage dvice as defined in claim 1, wherein:

said thread guide disk comprises an annular disk member.

4. A weft thread storage device for a weaving machine, comprising:

means defining a predetermined axis at a stationary location laterally of a weaving shed of the weaving machine;

a winding reel having a weft thread withdrawal face and being arranged eccentrically with respect to said predetermined axis of the weft thread storage device;

said winding reel containing a plurality of radially adjustable peripheral thread support rods;

a balloon-breaker housing for substantially preventing excessive ballooning of weft thread to be withdrawn from said winding reel and which is to be inserted into a weaving shed of the weaving machine;

said balloon-breaker housing having an axis extending eccentrically with respect to said winding reel;

a thread guide disk arranged upon said weft thread withdrawal face of said winding reel substantially concentrically in relation to said balloon-breaker housing and having a circumference which extends at a substantially constant radial distance from said balloon-breaker housing;

said predetermined axis defining a stationary axis;

said winding reel being arranged to rotate eccentrically about said stationary axis of the weft thread storage device; and said balloon-breaker housing being fixed in relation to said stationary axis.

5. A weft thread storage device for a weaving machine, said weft thread storage device defining a stationary axis and comprising:

a winding reel eccentrically adjustable relative to said stationary axis and defining an axial direction;

said winding reel containing circumferential guiding elements which are adjustable relative to each other for eccentrically adjusting said winding reel relative to said stationary axis and which guide a weft thread to be stored by the weft thread storage device for insertion into a weaving shed formed in said weaving machine;

said winding reel further containing an end face which extends transversely relative to said stationary axis and over which said weft thread is withdrawn in said axial direction defined by said winding reel for said insertion of said weft thread into said weaving shed formed in said weaving machine;

a balloon-breaker surrounding said end face of said winding reel;

said balloon-breaker being substantially coaxially arranged relative to said stationary axis and being provided for said weft thread which is withdrawn from said winding reel for said insertion of said weft thread into said weaving shed formed in said weaving machine;

said winding reel containing at said end face thereof, a substantially disk-like thread guide element having a circumferential portion;

said circumferential portion of said substantially disk-like thread guide element extending substantially concentrically relative to said stationary axis and at a substantially constant circumferential distance from said balloon-breaker;

said winding reel defining a circumference;

said substantially disk-like thread guide element eccentrically protruding past at least part of said circumference defined by said winding reel; and said balloon-breaker and said circumferential portion of said substantially disk-like thread guide element conjointly defining a thread withdrawal space devoid of further guide means.

6. The weft thread storage device as defined in claim 5, wherein:

said circumferential guiding elements contained in said winding reel constitute a drum-shaped body and a plurality of bracket-like guiding supports;

said bracket-like guiding supports being radially displaceable relative to said drum-shaped body;

said drum-shaped body of said winding reel defining an end face; and said end face of said drum-shaped body constituting said end portion at which said winding reel contains said substantially disk-like thread guide element.

7. A weft thread storage device for a weaving machine, said weft thread storage device defining a stationary axis and comprising:

a winding reel eccentrically adjustable relative to said stationary axis and defining an axial direction;

said winding reel containing circumferential guiding elements which are adjustable relative to each other for eccentrically adjusting said winding reel relative to said stationary axis and which guide a weft thread to be stored by the weft thread storage device for insertion into a weaving shed formed in said weaving machine;

said winding reel further containing an end face which extends transversely relative to said stationary axis and over which said weft thread is withdrawn in said axial direction defined by said winding reel for said insertion of said weft thread into said weaving shed formed in said weaving machine;

a balloon-breaker surrounding said end face of said winding reel;

said balloon-breaker being substantially coaxially arranged relative to said stationary axis and being provided for said weft thread which is withdrawn from said winding reel for said insertion of said weft thread into said weaving shed formed in said weaving machine;

said winding reel containing at said end face thereof, a substantially disk-like thread guide element having a circumferential portion;

said circumferential portion of said substantially disk-like thread guide element extending substantially concentrically relative to said stationary axis and at a substantially constant circumferential distance from said balloon-breaker;

said winding reel defining a circumference;

said substantially disk-like thread guide element eccentrically protruding past at least part of said circumference defined by said winding reel;

said winding reel being arranged for rotation about said stationary axis defined by the weft thread storage device; and said balloon-breaker being fixedly arranged relative to said stationary axis defined by the weft thread storage devices.

* * * * *

UNITED STATES PATENT AND TRADEMARK OFFICE

CERTIFICATE OF CORRECTION

PATENT NO. : 4,633,917
DATED : January 6, 1987
INVENTOR(S) : GIANNI RIBOLI

It is certified that error appears in the above—identified patent and that said Letters Patent is hereby corrected as shown below:

Column 2, line 54, at the beginning of the line after "rods" please insert --5--

Column 2, line 62, at the end of the line after "rods" please delete "15" and insert --5--

Column 4, Claim 3, line 1, please delete "dvice" and insert --device--

Signed and Sealed this

Twenty-eighth Day of April, 1987

*Attest:*

DONALD J. QUIGG

*Attesting Officer*

*Commissioner of Patents and Trademarks*